US005477229A

United States Patent [19]

Caille et al.

[11] Patent Number: 5,477,229

[45] Date of Patent: Dec. 19, 1995

[54] ACTIVE ANTENNA NEAR FIELD CALIBRATION METHOD

[75] Inventors: Gérard Caille; Thierry Dusseux, both of Tournefeuille; Christian Feat, Toulouse, all of France

[73] Assignee: Alcatel Espace, Courbevoie, France

[21] Appl. No.: 129,374

[22] Filed: Sep. 30, 1993

[30] Foreign Application Priority Data

Oct. 1, 1992 [FR] France ..... 92 12092

[51] Int. Cl.[6] ..... H01Q 3/00

[52] U.S. Cl. ..... 342/360; 342/173; 342/174

[58] Field of Search ..... 342/360, 173, 342/174

[56] References Cited

U.S. PATENT DOCUMENTS

| | | | |
|---|---|---|---|
| 4,926,186 | 5/1990 | Kelly et al. | 342/360 |
| 5,038,146 | 8/1991 | Troychak et al. | 342/173 |
| 5,072,228 | 12/1991 | Kuwahara | 342/360 |
| 5,241,316 | 8/1993 | Pringle | 342/174 |
| 5,248,982 | 9/1993 | Reinhardt et al. | 342/174 |

FOREIGN PATENT DOCUMENTS

0496381A2 7/1993 European Pat. Off. .

OTHER PUBLICATIONS

Japanese Patent Abstract JP60089766 dated May 20, 1985.

David N. McQuiddy, Jr. et al., "Transmit/Recieve Module Technology . . . Radar", *Proceedings of the IEEE*, vol. 79, No. 3, Mar. 1991, pp. 308–341.

French Search Report 9212092 dated Jun. 18, 1993.

*Primary Examiner*—Theodore M. Blum

*Attorney, Agent, or Firm*—Sughrue, Mion, Zinn, Macpeak & Seas

[57] ABSTRACT

In a method of calibrating an active antenna the active elements of a transfer function matrix are measured using a near field probe for each radiating source of the antenna. The probe is placed in front of each source in succession and each source is excited in turn with the opposite phase and with all the other sources of the array excited normally. In the case of linear superposition of radiated fields, the measurements obtained by this method yield the elements of the transfer function matrix directly. This allows for phase and amplitude errors due to the components of the active antenna and for the effects of coupling between adjacent sources which modify the theoretical characteristics of the antenna. In the non-linear case the measurements are repeated and the matrix is obtained by iteration based on a comparison of the theoretical values used to control the antenna and the measured fields actually obtained. Measurements carried out on individual active modules prior to assembly of the antenna can be used in one variant of the method.

17 Claims, 3 Drawing Sheets

SOURCES
S1
S2
Si
SN
a1
b1
ai
bi
aN
bN
Ai,φ1
Ai,φi
AN,φN
ACTIVE MODULES
M
3
CONTROL UNIT
SPLITTER
2
TRANSMITTER
1

SOURCES
b2
bi
bN
S1
S2
Si
SN
a1
a2
ai
aN
Ai,φ1
Ai,φi
AN,φN
ACTIVE MODULES
M
13
CONTROL UNIT
COMBINER
12
RECEIVER
11

Fj
M
L
E1
E2
Ei
P
Q
R
D
I1
I2
Ii
a1
a2
ai
HPA
LNA
HPA
LNA
HPA
LNA
c1
c2
ci

ACTIVE ANTENNA NEAR FIELD CALIBRATION METHOD

BACKGROUND OF THE INVENTION

1. Field of the Invention

The present invention concerns the manufacture and measurement of active antennas comprising a large number N of parallel channels. Active antennas use this number N of channels to form the radiation diagram of the antenna by superposition of the fields resulting from the excitation of each element.

2. Description of the Prior Art

During the process of designing an antenna, theoretical calculations based on desired radio frequency characteristics determine the geometry of the radiating sources and the operating parameters of those sources and the associated active modules; these parameters include the amplifier gain, the dynamic range and/or the relative phase-shift needed to obtain the required depointing. These calculations are based on hypotheses and mathematical relations which describe physical principles and on physical data concerning the antenna and its component parts. This data must be determined or confirmed by measuring the radio frequency characteristics of the antenna.

The invention concerns a method of calibrating active antennas using near field measurements on the antenna and its radiating sources and a specific calculation to determine control parameters to be applied to the active modules and the resulting far field.

The active antenna to which the method in accordance with the invention applies may be a transmit or receive antenna or an antenna alternating between transmission and reception (e.g. a radar antenna).

In the case of a transmit antenna, the signal from a low-level centralized transmitter is divided into N supposedly identical signals on N channels by means of a power splitter. A variable gain active module on each channel then amplifies the signal and applies a variable phase-shift to the amplified signal before it is transferred to the radiating source (see FIG. 1).

In the case of a receive antenna the signal received on each radiating source is amplified and phase-shifted in a variable gain active module applying a variable phase-shift. The N amplified signals on the N channels are then combined by a power combiner and transferred over a single channel to a centralized receiver (see FIG. 2). This arrangement is the opposite of the first arrangement and, from the theoretical point of view, is strictly symmetrical to it.

In the case of antennas which alternately transmit and receive, such as radar antennas, a single device acts as the combiner for reception and as the splitter for transmission and the active modules include a device switching between a receive channel including a low-noise amplifier and a transmit channel including a power amplifier. Depending on the design of the active module, a phase-shifter and a variable attenuator are provided for each channel or if they are of the reciprocal type they may be provided on a single channel connected alternately to the two transmit/receive channels by an SPDT switch (see FIG. 3).

When designing an active antenna the control signals required for beam shaping are calculated by means of a computer using hypotheses and approximations which although they render the calculations performable do not always conform to measurable reality where the performance of the antenna is concerned.

The sources are assumed to be identical, for example, whereas in reality their radio frequency characteristics are subject to small variations due to manufacturing tolerances. The same applies to the active modules: their impedance, gain, insertion loss and phase may vary from one module to another with the result that an identical control signal does not produce exactly the same phase-shift or amplitude from one source to another.

It is also assumed that the gains are exactly the same and entirely independent of the phase and vice versa although this is not so in practise and slight influence of each on the other is inevitable.

Further, the position of a source in the array can influence the radio frequency characteristics of the source through coupling with surrounding sources. For example, the characteristics of a source at one end of the array are different than those of a more central source surrounded by neighboring sources.

Finally, the theoretical calculations assume that the source amplifiers are linear devices. This means that the resulting fields at the source can be predicted from the control signal applied to the amplifier. If the amplifier is operating close to its saturation point, which is often the case with transmission, the control signals required to obtain a given amplitude differ from those yielded by linear theoretical calculations.

The calibration method in accordance with the invention allows for these discrepancies between reality and the ideal theoretical situation in relation to far field theoretical calculations used in the characterization and design of an active antenna. The results obtained are particularly valuable for antennas having precisely shaped radiation diagrams, especially computer-driven beam shaping antennas.

The problem arising from the existence of these errors as compared with the ideal antenna made exclusively from ideal components is hardly new. The method in accordance with the invention is concerned with three types of error: spread of the radio frequency characteristics of the components (due to manufacturing tolerances), phase and gain control errors and variable coupling between radiating sources dependent on their position within the array. Prior art solutions are unsatisfactory for the reasons stated hereinafter.

To alleviate the spread of radio frequency characteristics between the modules, assumed to be identical for identical components, it is known to incorporate specific calibration circuits similar to the active antenna. In a transmit antenna these circuits sample a known fraction of the signal output by each active module and feed it to the antenna control unit. In a receive antenna these circuits inject a known signal into the receive circuit and recover it at the other end of the normal path of an antenna receive channel.

This solution has two major drawbacks: it requires a dedicated circuit for each module which significantly increases the already high price of an active antenna and the overall size, weight, electrical power consumption, heat dissipation and complexity of the system are increased accordingly. Further, the resulting calibration allows only for parameter spread affecting the circuits and neglects the effect of coupling between sources and the effect of differences between the radiating sources themselves due to manufacturing tolerances.

Another known method is to install a test antenna such as a horn or dipole antenna at a particular distance from the active antenna to be calibrated. The transfer function between the test antenna and each channel is determined by measuring the field delivered by each channel in succession using the following method. All channels except the channel under test are switched out of circuit during the measurement of the channel under test and this procedure is applied channel by channel.

Using this prior art solution requires modification to the construction of the basic active module to incorporate the function for connecting all channels except the channel under test in turn to a matched load.

One option is to maintain fixed control of the other channels while the channel in question is controlled in a variable manner, which causes the phase to rotate. In theory this enables the various phase states of the channel to be characterized.

However, this method suffers from the problem of coupling between neighboring sources, which is not measured under conditions representative of normal operation: by rotating the phase of the channel being calibrated the radiation of the other sources is disturbed slightly which disrupts the measurement of the radiated field.

The prior art has also touched on the problem of theoretical modelling of such coupling. Various models have been put forward according to the type of radiating source. The models are directed to determining by calculation the actual radiation from the source $S_i$ if surrounded by N–1 other sources $S_j$ ($j \neq i$) which are all excited by waves $a_j$. However, the actual sources are very difficult to model correctly, especially printed circuit antennas ("patches"). However, patches are increasingly used in active antennas and the level of coupling between radiating sources of this type is particularly high.

Methods of calculating coupling theoretically are often subject to error as are methods for modifying such coupling (to reduce induced mismatching of the antenna) by coupling holes between the access guides, by the careful disposition of a dielectric radome, etc. Methods of predicting coupling theoretically should enable correction by calculation of their disturbing effects in a calibration sequence; however, in the prior art this is always independent of the measurement of parameter spread due to manufacturing tolerances or control errors.

The method in accordance with the invention can alleviate these drawbacks of the prior art and correct simultaneously the three types of error summarized above.

SUMMARY OF THE INVENTION

The invention consists in a method of calibrating an active antenna having N radiating sources in which method a probe is placed in front of each radiating source in succession to measure the near field in front of said source for an antenna configuration required to obtain a required radiation diagram (pattern) and during said measurement of said near field in front of said source a phase shifter of each channel in turn is caused to shift the phase of radiation by said channel 180° relative to its nominal value with each of the other N–1 sources operating at their respective nominal value for said configuration in order to obtain the required radiation diagram.

The invention thus proposes a method of calibrating an active antenna having N radiating sources disposed in an array with coupling between said sources which are energized by active modules comprising variable phase shift means and variable gain control means, said sources, said active modules, said phase shift means and said gain control means having close manufacturing tolerances and said phase shift means and said gain control means being subject to inaccuracies of response conditioned by a given control value, in which method near field measurements are carried out using an appropriate probe to characterize simultaneously the effects of said coupling between sources, said manufacturing tolerances and said inaccuracies.

In a more specific method in accordance with the invention the gain and phase control values for a required antenna configuration to obtain a required radiation diagram are first determined by the above method and said control values are applied to said phase shift and gain control means and said near field measurements are repeated with said control values to obtain closer corrections to said values. This procedure may be repeated as required; iteration over a sufficient number of cycles can yield any accuracy in respect of the specified parameters.

In another more specific method in accordance with the invention a calibration table is drawn up on the basis of measurements carried out on said active modules before the antenna is assembled and this table then supplies the modified phase shift and gain control values used after a single near field measurement by the method described in the preamble.

The method in accordance with the invention and its variants can be applied to transmit and receive active antennas and to active antennas which alternately transmit and receive.

In the case of a radar antenna the method in accordance with the invention is applied twice: once for the antenna transmitting to determine the transmit phase shift and gain control values and again for the antenna receiving to determine the receive phase shift and gain control values.

In method in accordance with the invention has many advantages as compared with prior art methods for calibrating active antennas. It enables calibration of the antenna allowing for all kinds of spread which cause discrepancies between the actual radiation diagram and the theoretical diagram as calculated by software.

In the prior art characterizing an antenna by near field measurements requires a much greater number of individual measurements. For each of the N radiating sources, with the others terminated to a matched load, it is necessary to carry out a measurement at each point of a square array with sides $\lambda/2$ over a surface significantly larger than the antenna: taking an antenna with N=96 sources, for example, each with a surface area of 2.8 $\lambda^2$, approximately 100 000 measurements are required for complete calibration of the 96 sources. The method in accordance with the invention requires only N (N+1) measurements where N is the number of radiating sources. In the above example 9 312 measurements are required.

The method in accordance with the invention thus achieves a significant time saving in antenna calibration (by a factor of 11 in the above example). Also, the method proposed is well suited to iterative implementation for approximating the final performance of the antenna to any specified accuracy under actual operating conditions.

Because the method in accordance with the invention allows for variations in the radio frequency characteristics of the antenna components, it is possible to use wider tolerances for the components. The cost of the components can therefore be reduced, so reducing the overall cost of the antenna.

Compared to some prior art methods, the construction of the antenna is also simplified in that the method in accordance with the invention does not require any dedicated circuits for sampling or injecting calibration signals.

Other advantages and features of the method of the invention will emerge from the following detailed description given with reference to the appended drawings.

DETAILED DESCRIPTION OF THE INVENTION

The same items are identified by the same references in all the figures and non-material functions are identified by symbols to facilitate the explanation of the method of the invention.

Figure 1:
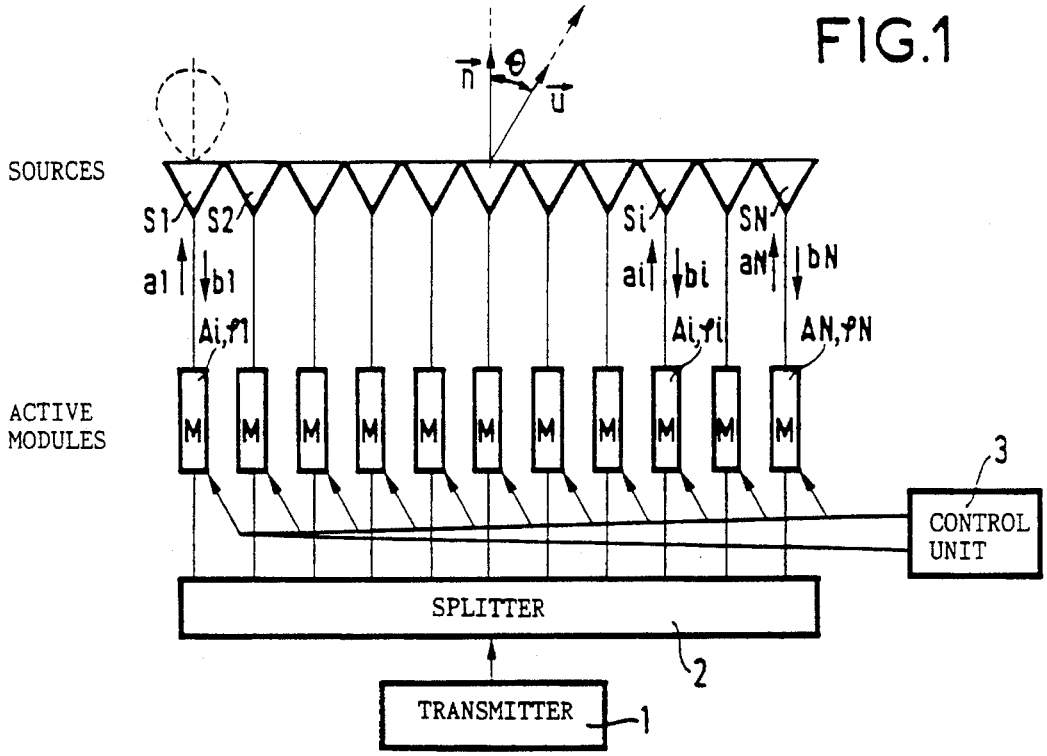
FIG. 1, already referred to, is a diagram showing the operation of an active transmit antenna.

FIG. 1 is a diagrammatic cross-section through one example of a linear array transmit active antenna. The example shown in this figure can easily be generalized to a two-dimensional or similar array. Referring to the figure, a low-level transmitter 1 feeds the N radiating sources of the linear array $S_1, \ldots, S_i, \ldots S_N$ through a passive power splitter 2. Active modules $M_i$ between the splitter 2 and the sources $S_i$ apply a phase-shift $\phi_i$ and amplification with gain $A_i$, the phase-shift and gain being controlled by a control unit 3. The complex signals $a_i$ at the output of the active modules $M_i$ are fed to the radiating sources $S_i$ from which they are radiated. If there is an impedance mismatch between the modules M and the sources S there may be reflected signals $b_i$ propagating in the opposite direction to the wanted signals.

The waves radiated by the sources S are superposed with their respective amplitude and phase and in accordance with beam shaping calculations to radiate in a required direction with a lobe shaped to suit the intended application.

Figure 2:
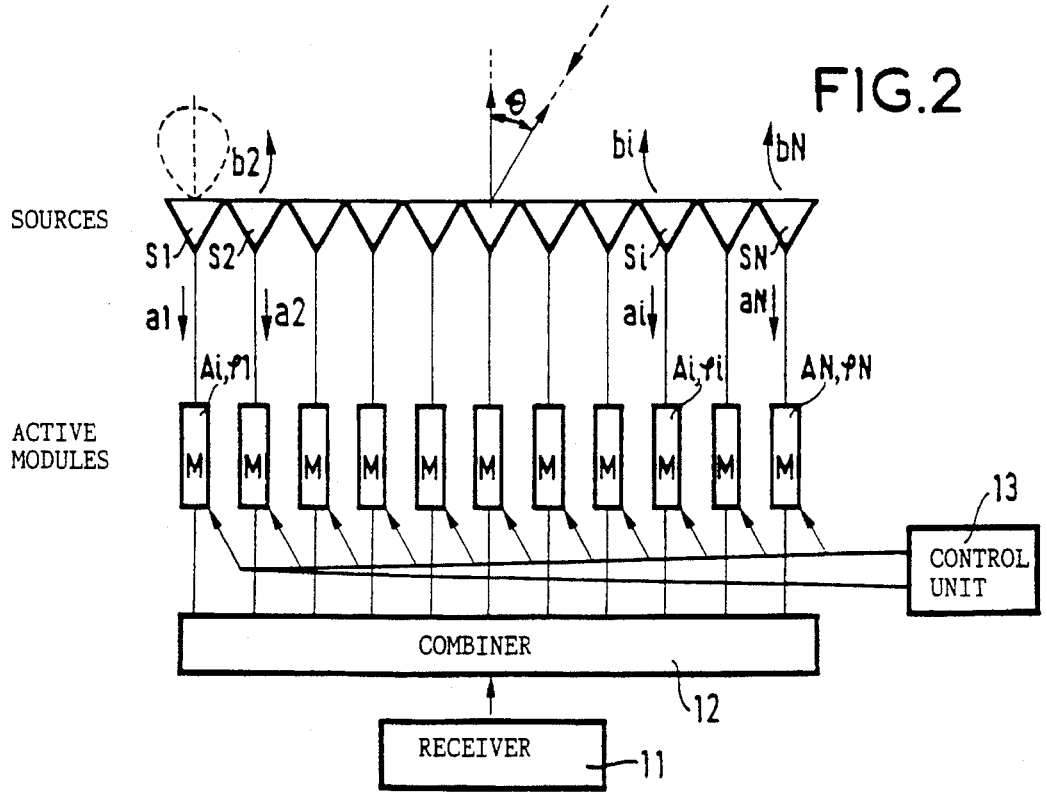
FIG. 2, already referred to, is a diagram showing the operation of an active receive antenna.

FIG. 2 is a diagrammatic cross-section of one example of a linear array receive active antenna. The example shown in this figure can easily be generalized to the case of a two-dimensional or similar array. Referring to the figure, a receiver 11 is fed through a passive combiner 12 by the N sources $S_1, \ldots, S_i, \ldots S_N$ of the linear array. Active modules $M_i$ between the combiner 12 and the sources $S_i$ apply a phase-shift $\phi_i$ and amplification with gain $A_i$. The phase-shift and gain are controlled by a control unit 13. The complex signals $a_i$ are fed from the radiating sources $S_i$ to the inputs of the active modules $M_i$ where they are amplified. The gain and phase of each signal are controlled independently of the other signals. If there is an impedance mismatch at the input of the sources S there may be reflected signals $b_i$ propagating in the opposite direction to the wanted signals.

The waves arriving at the sources S combined with the amplitude and phase assigned to them in accordance with beam shaping calculating then reach the receiver 11 in a coherent manner, coming from a particular direction, with a lobe shaped according to the intended application.

Figure 3:
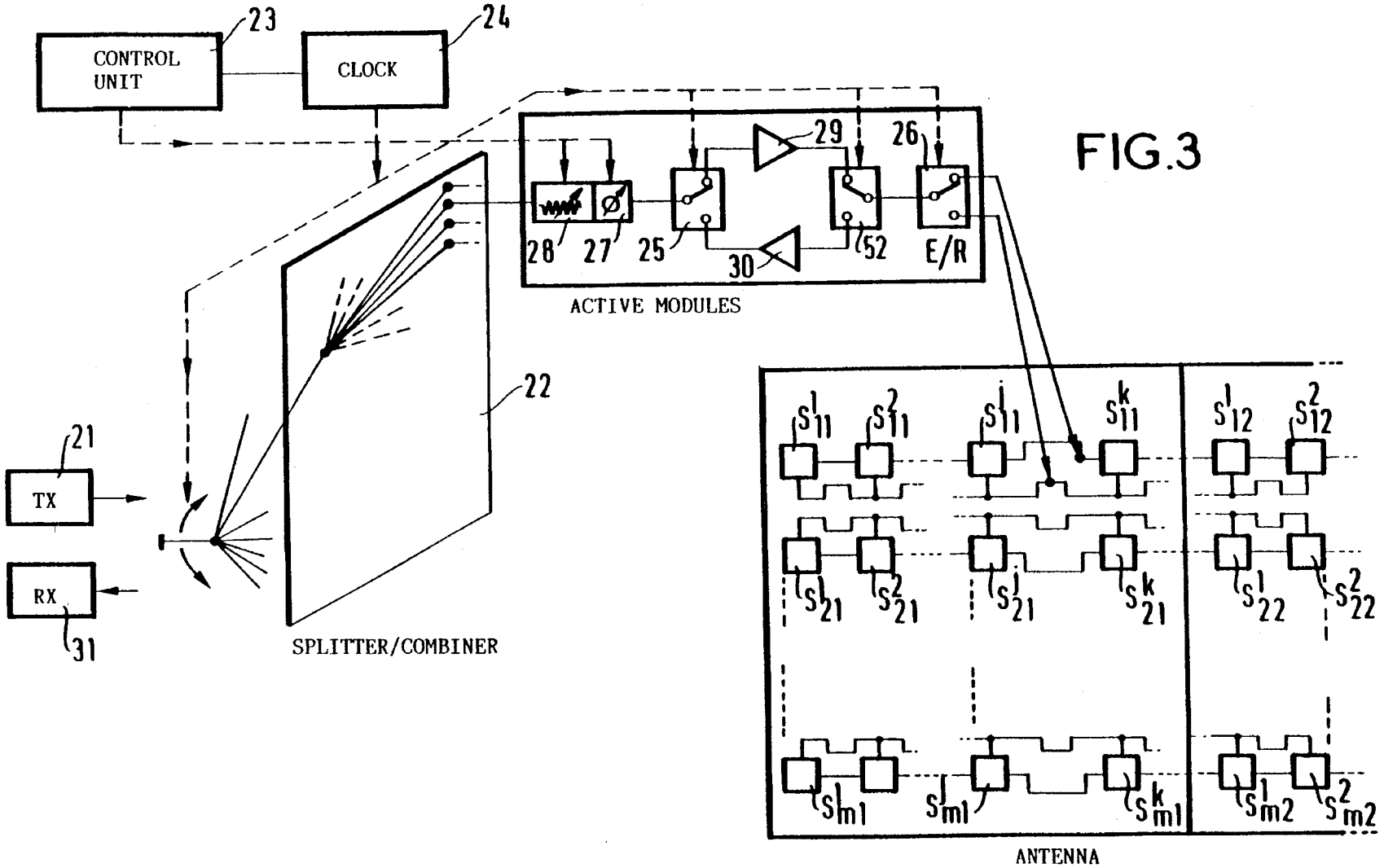
FIG. 3, already referred to, is a diagram showing the operation of an active antenna operating alternately as a transmit antenna and as a receive antenna.

FIG. 3 is a diagrammatic representation of a radar active antenna transmitting and receiving alternately. The transmit/receive functions are alternated by switches 25, 52 controlled by a synchronization clock 24. Referring to FIG. 3, a switch 26 can select orthogonal polarizations for reception and for transmission. As in the previous two examples, the phase and the gain are controlled by a control unit 23 for transmission and for reception. The control parameters for a given receive channel are not necessarily the same as when the same channel is used to transmit.

The figure shows a single transmit/receive active module comprising a variable phase-shifter 27 and a variable attenuator 28 for adjusting the gain of the module. However, each channel requires an active module and in this example there are m.m' channels each connected to a radiating source comprising K patches $S_{ij}^1$ through $S_{ij}^k$.m' is the number of columns of sources of which only the first and second are shown, and only in part In transmit mode the transmitter 21 supplies signals to a splitter/combiner 22 which feeds the active modules E/R. The phase and the attenuation of the signal are determined by the variable phase-shifter 27 and the variable attenuator 28 according to instructions given by the control unit 23. The switches 25 and 52 are then controlled by the clock 24 to engage the power channel and the signal is amplified by the power amplifier 29 before being sent to the radiating sources $S_{ij}$.

In receive mode the receiver 31 receives signals from the active modules E/R via the combiner/splitter 22. In the modules E/R the signals from the radiating sources $S_{ij}$ are switched by the switches 25, 52 onto the receive channel where they are amplified by a low-noise amplifier 30, phase-shifted by the variable phase-shifter 27 controlled by the control unit 23 and attenuated by the variable attenuator 28 also controlled by the control unit 23.

The antenna architectures of FIGS. 1 through 3 are well known to the man skilled in the art and a more detailed description is not needed to illustrate the principles of the invention.

Figure 4:
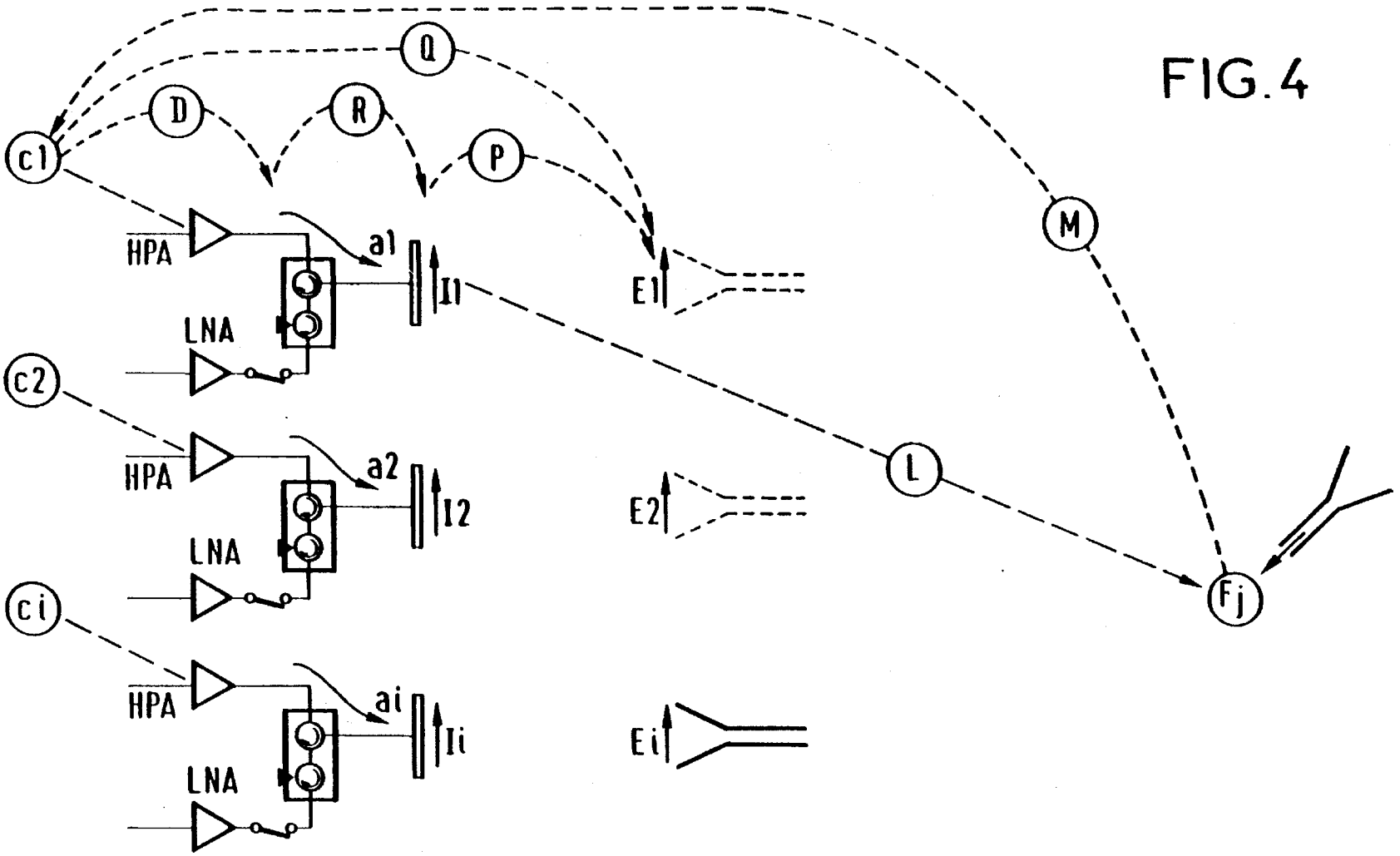
FIG. 4 is a symbolic representation of the relationship between various vector and matrix quantities as determined by the method in accordance with the invention.

To give a better understanding of the calibration method in accordance with the invention the following description uses matrix algebra. In this description scalar magnitudes are denoted by roman letters, where appropriate with a subscript to indicate their position in a vector or in a matrix, vector quantities are denoted by underlined roman letters, and matrix quantities are denoted by BOLDFACE uppercase letters. All these quantities are complex, having a magnitude (amplitude) and a phase. FIG. 4 is a symbolic representation of their inter-relationship.

For example, the following vector:

$$\underline{C} = \begin{bmatrix} c_1 \\ \cdots \\ c_i \\ \cdots \\ c_N \end{bmatrix}$$

represents the N amplitude and phase control parameters of the active antenna with: $|c_i|_{max}=1$, which means that the maximum channel gain is taken as a reference, i.e. as 0 dB.

The vector:

$$\underline{A} = \begin{bmatrix} a_1 \\ \cdots \\ a_i \\ \cdots \\ a_N \end{bmatrix}$$

represents the N real excitations, i.e. the waves incident on the radiating sources.

A dispersion matrix D defines the relationships between the control parameters and the excitations:

A=DC. In the diagonal N×N matrix D the element $d_i=a_i/c_i$ represents the difference in amplitude and in phase between the required excitation and the real excitation of channel i. This matrix allows for manufacturing tolerances and for inaccuracies of the control system.

The vector I represents the "illumination" or the "field at the aperture":

$$\underline{I} = \begin{bmatrix} I_1 \\ \cdots \\ I_i \\ \cdots \\ I_N \end{bmatrix}$$

This terminology is routinely used in the specialist literature to characterize the electromagnetic field on the radiating plane. To simplify the calculations it is assumed that the radiating sources are monomode sources and only the nominal polarization direction is considered. The consequence of these hypotheses is that the distribution of this electric field can be characterized by a single complex number (magnitude and phase). This can be illustrated by a few examples:

If the radiating sources are open waveguides, $I_i$ represents the amplitude and the phase of the electric field where it is maximal, in the median plane parallel to the shorter sides of the guide for a $TE_{10}$ fundamental mode wave.

If the radiating sources are half-wave dipoles, $I_i$ represents the current at their center point. If they are "patches" $I_i$ represents the current density at their center.

If the radiating sources are resonant slots in the wall of the waveguide, $I_i$ represents the voltage between the two edges of the slot midway along its length, i.e. at the place where this voltage is maximal.

The latter two examples show that the physical magnitude of $I_i$ is not necessarily a magnetic or electric field, but may be some other magnitude characterizing the radiation of the source, this magnitude being proportional to the field at the aperture of the source.

A matrix R is defined to characterize the radiation phenomena and enables the illumination I to be derived from the real excitations A by the equation: I=RA where R is the N×N matrix and would be diagonal if there were no coupling between the sources:

$I_i=r_ia_i$ shows that in this case the illumination would depend only on the wave incident on the source i.

As emphasised above, however, coupling between nearby sources introduces errors into the estimate of the radiated field if they are not allowed for in the computations. The matrix R therefore comprises non-diagonal elements representing the contribution of neighboring sources to the illumination at a given point. The field at the source $S_i$ therefore depends on the waves $a_j$ incident on the other sources, with coupling coefficients $r_{ij}$:

$$I_i = \sum_{j=1}^{N} r_{ij} \times a_j$$

which can be written in matrix notation as follows: I=RA.

Taking the above example of dipoles or "patches" the coupling can be represented in the conventional form of a diffraction matrix S made up of elements $[s_{ij}]$; a reflected wave:

$$b_i = \sum_{j=1}^{N} s_{ij} \times a_j$$

is superposed on the incident wave ai at the source si. In this matrix S the element $s_{ii}$ represents the reflection coefficient of the source $S_{i\neq j}$ terminated by the proper load.

The radiation is proportional to the normalized current divided by the impedance of the line:

$$I_i = a_i - b_i = a_i - \sum_{j=1}^{N} s_{ij} \times a_j$$

where: I=(U−S)A and U is the N×N unit diagonal matrix.

A second example concerns the case of a slotted waveguide array with all the slots identical and disposed in the same manner in each guide. The illumination then depends on the voltages at the slots:

$$I_i = \theta_i = a_i + b_i = a_i + \sum_{j=1}^{N} s_{ij} \times a_j$$

where: I=(U+S)A and U is the N×N unit diagonal matrix. The matrix S is still the coupling coefficient "diffraction" matrix.

If a "near field" probe is placed a few wavelengths away from the center of the source $S_i$ it senses an electric field:

$$E_i = \sum_{j=1}^{N} p_{ij} \times I_j$$

Note that $E_i$ is a linear function of the illumination of each source, mainly the source $S_i$ but also the others.

A "near field" column vector E and the "near field radiation" N×N matrix P are then defined such that E=PI with:

$$\underline{E} = \begin{bmatrix} E_1 \\ \cdots \\ E_i \\ \cdots \\ E_N \end{bmatrix}$$

The final step in this procedure is to measure the far field diagram of the active antenna. A test receive antenna is disposed at a distance which is large compared to $2D^2/\lambda$ where D is the largest dimension on the radiating plane of the antenna and $\lambda$ is the wavelength of the radiation. The active antenna is rotated to sample its radiation diagram in a sufficient number p of directions in space, each time measuring the amplitude and the phase of the signal received by the test antenna, to obtain the values $F_j$ of the "far field diagram" which is represented by the column vector:

$$\underline{F}=\begin{bmatrix} F_1 \\ \cdots \\ F_j \\ \cdots \\ F_p \end{bmatrix}$$

A "far field radiation" N×p matrix L is then defined such that F=LI.

The procedure is strictly linear to this point and cannot cater for non-linearities due to amplifiers operating near saturation, for example. For a more exact treatment in this case the method must be adapted as explained below. In any event, this phenomenon is relevant only to the transformation: A=DC, all the other relationships remaining linear.

All the equations remain linear in the case of a receive antenna. Consider first the simplest case of a linear transmit antenna to illustrate the principle of the calibration method in accordance with the invention. The first step is to measure each of the N×N complex terms $q_{ij}$ of the matrix: Q=PRD which is derived from: E=QC=PRDC.

The near field probe enables the elements $E_i$ of the vector E to be measured directly, as explained above.

The calibration method in accordance with the invention provides the values of all vectors and matrices from a set of near field measurements carried out for a number N of positions of the probe equal to the number of radiating sources: for each position N+1 measurements are carried out (initial control value+switching of each of the N bits by 180°); the total number of measurements is thus N(N+1). The initial calibration may be followed by iterative recalibration to obtain the required precision. The initial calibration is described first.

The measurement is carried out as follows:

1) an equal amplitude and equal phase law is commanded, i.e. $c_i=1$ for all values of i from 1 through N;
2) the near field probe is placed in front of each source $S_i$ in succession and a complex signal $z_i$ is obtained at the receiver proportional to the electric field $E_i$ at the probe;
3) the bit of the phase shifter of channel j of the active antenna is switched 180°; a new signal $z'_{ij}$ is obtained at the receiver.

These two measurements are characterized by the following equations:

$$z_i=q\sum_{j=1}^{N} q_{ij}\times c_j=q(q_{i1}c_1+\ldots+q_{ij}c_j+\ldots+q_{iN}c_N) \quad (1)$$

in which the constant q characterizes the base of the near field measurement (q is a function of the probe and the receiver), and $$z'_{ij}=q(q_{i1}c_1+\ldots+q_{ij}(-c_j)+\ldots+q_{iN}c_N) \quad (2)$$

The complex difference between equations (1) and (2) is:

$$z_i-z'_{ij}=2q(q_{ij}\cdot c_j)$$

or, since in this case cj=1:

$$q_{ij}=\frac{z_i-z'_{ij}}{2q} \quad (3)$$

The value of $z_i$ is measured at each position of the probe in front of a source $S_i$ after which the N values of $z'_{ij}$ are measured by switching the bits of all the channels 180° in turn. Equation (3) above gives immediately the N elements $q_{ij}$ of row i of the matrix Q.

The receiver used with the probe must be able to measure complex signals with good accuracy. It may be a receiver with two mixers and two channels I (in-phase) and Q (phase quadrature), for example.

The resulting matrix Q is called the initial calibration matrix because it can be used to calculate control values to obtain a required far field radiation diagram. The radiation diagram is characterized by the vector F of p measured or calculated field values. The p values specified by the calculation represent the main characteristics of the required radiation and are used for beam shaping. The calculation must then determine how to obtain these far field values from control parameters for the antenna.

The control values can be obtained from the vector F by matrix transformations using the initial calibration matrix Q. To summarize:

The near field measurements yield:

$$E=PI=QC$$

Also:

$$F=LI\rightarrow I=L^{-1}F$$

Accordingly:

$$C=Q^{-1}E=Q^{-1}PI=Q^{-1}PL^{-1}F$$

The control values are therefore calculated from:

$$C=Q^{-1}PL^{-1}F$$

Q-1 is obtained by inverting the N×N initial calibration matrix Q measured term by term as described above. $L^{-1}$ is the transformation of the far field to the field at the aperture. P is the transformation from the field at the aperture to the near field. These latter two matrices are governed by the basic equations of antenna theory which are familiar to the man skilled in the art who will have no difficulty in implementing them in software.

The calibration method in accordance with the invention therefore yields the matrix $M=Q^{-1}PL^{-1}$ which specifies the control values required to obtain a given far field in the linear case. Manufacturing tolerances are allowed for in this matrix M since Q=PRD, where D is the dispersion matrix. Coupling is also allowed for in the matrix R.

The equations remain the same for a receive antenna: the only difference is that for the near field measurements the probe transmits and the active antenna receives.

In the case of a non-linear transmit antenna the control values obtained by this first measurement may be insufficiently accurate. To improve them it is possible to iterate from these first values, as described later.

A preferred variant of the method in accordance with the invention begins with a first set of measurements as described above and alleviates control errors resulting from amplification non-linearities and imperfections of the variable phase shifters and attenuators (also non-linearities). The control values C obtained from this calibration are applied to the respective phase shifters and attenuators. The measurement procedure is then repeated to obtain a second calibration matrix Q' which differs slightly from the first matrix Q because the dispersion matrix D has changed somewhat for the new control values $c_i$. The new dispersion matrix D' will have diagonal terms in the form:

$$d'_i = a'_i / c'_i$$

A second set of control values is then calculated:

$$C' = (Q'^{-1} P L^{-1}) F$$

and the mean-square deviation between this control law and the previous control law is calculated:

$$\sigma^2 = \sum_{i=1}^{N} |c'_i - c_i|^2$$

If the mean-square deviation is less than the target for the required accuracy the iteration stops; for a target accuracy of 1° in phase and 0.15 dB in amplitude, for example:

$$\sigma^2 = N(\epsilon^2_\phi + \epsilon^2_a) = N \times 6.03 \times 10^{-4}$$

where $\epsilon_\phi$ and $\epsilon_a$ are the accuracies expressed in radians and in relative amplitude.

If the convergence criterion is not satisfied the iteration continues in the same manner by measuring the new calibration matrix Q" for the control values C' to obtain the new re-optimized control values:

$$C'' = (Q''^{-1} P L^{-1}) F$$

The iteration is continued until the required accuracy is achieved. In practise only a few iterations are needed.

In some cases the method in accordance with the invention can allow for measurement data obtained prior to calibration of the antenna. For example, an active antenna comprises several hundred or possibly several thousand active modules and is usually constructed from components which are tested before they are integrated into the antenna. Also, control characteristics can be measured at individual active modules to verify that they are operating correctly prior to assembly.

In one variant of the method in accordance with the invention control errors are allowed for in calibration of the antenna using data concerning each active module. This data comprises a complex value (magnitude and phase) for each active module in question as appropriate to the control value applied. The near field measurements are then carried out as previously with a uniform excitation law $c_i=1$ and for all values of i; for each required far field diagram the control values $C=Q^{-1}PL^{-1}F$ are calculated using in Q=PRD the dispersion matrix for $c_i=1$ for all values of i; however, for the thus determined value of C D will be slightly different (D') yielding a new value C'; this process is repeated by a subroutine using module measurement tables. In this variant of the method a near field measurement is used to calculate the control values C appropriate to each diagram F using this subroutine. The iteration applies only to the dispersion matrix D as a component of the matrix transformation Q=PRD. This latter equation shows that the two methods are theoretically equivalent to the extent that the matrices P and R are independent of the control state.

The choice between the two variants is based on criteria of ease of implementation. In the first variant M iterations each comprise N(N+1) near field probe measurements for each different radiation diagram required. In the second variant each active module must be characterized individually but thereafter to determine the elements of the calibration matrix Q only one measurement of N(N+1) near field values is required, all other control laws being calculated from Q and the table of measurements carried out on the active modules.

The method in accordance with the invention can of course yield more accurate measurements subject to carrying out a greater number of near field measurements, for example measurements that are K times more accurate where K is an integer multiplier.

In one variant of the method of the invention if each active module is connected to a "sub-array" of radiating patches whose surface area is significantly greater than the optimal accuracy $\lambda/2 \times \lambda/2$ grid to measure the near field of the antenna the measurements are carried out using K positions per sub-network. This represents a move towards the ideal grid, achieved at the cost of an increase in the calibration time. However, the accuracy is improved by averaging each group of K measurements using a mathematical "projection" of the near field at these K points radiated by a single radiating sub-array. How this mathematical "projection" is achieved is described below.

The near field measurements $E_{nk}$ 'are carried out at N.K points corresponding to an equal number p=N.K of far field sampling directions. K times too many measurements $E_{nk}$ 'are thus available for characterizing the N antenna control values. The "projection onto the near field diagram of a source" comprises the following stages:

Before calibrating the complete active antenna the near field diagram e is measured:

$$\underline{e} = \begin{bmatrix} e_1 \\ \cdots \\ e_i \\ \cdots \\ e_K \end{bmatrix}$$

for a single radiating source at the K sampling points of its surface chosen as explained above.

After measuring $E_{nk}$ 'at p=N.K points in front of the active antenna (K points in front of each radiating source), giving the near field measurement "mesh", the K measurements corresponding to each mesh are projected onto e; for mesh number $n_0$:

$$\underline{E}'_{n_0} = \begin{bmatrix} \underline{E}_{n_0 1} \\ \cdots \\ \underline{E}_{n_0 i} \\ \cdots \\ \underline{E}_{n_0 K} \end{bmatrix}$$

This projection is mathematically expressed by the complex scalar product:

$$E_{n_0} = E'_{n_0} . e^*$$

where the symbol "*" indicates the complex conjugate.

The N.K measurements $E_{nk}$ 'are then replaced by N values:

$$\underline{E}=\begin{bmatrix} E_1 \\ \dots \\ E_i \\ \dots \\ E_N \end{bmatrix}$$

which are the means for the near field diagrams at each mesh weighted by the diagram of the source in front of this mesh, The N×N calibration matrix Q is calculated from this stage, as previously, by relating N near field measurements $E_n$ to each set of N control values $c_i$.

The mathematical operation of projection may be represented by the matrix equation:

$$E=T.E',$$

where T is an N×p matrix. The calibration formula is then:

$$C=(Q^{-1}T.P.L^{-1})F$$

In this equation:

F is a column matrix of p=N.K terms,

P and L are square matrices of p×p terms,

T reduces to N terms only,

Q is still an N×N matrix, and

C is a column matrix of N terms.

The advantage of this variant is that the accuracy of the results is increased by a factor $K^{1/2}$ by averaging K measurements for the mesh facing each source. This advantage is achieved at the cost of a number of measurements increased by a factor K and a commensurate increase in the size of the matrices to be calculated.

The choice is optimized according to the number of active modules, the number of different radiation diagrams and the number of iterations required to achieve the wanted accuracy.

The advantages of the method in accordance with the invention and variants thereof include those mentioned above. The calibration matrix $Q=[q_{ij}]$ relates the control values for the active antenna directly to the radiated near field and allows for all dispersion causing differences between the real radiation diagram and the theoretical diagram calculated by the software. Manufacturing tolerances are allowed for in the matrix $D=[d_i]$. Imperfections of the variable phase shifters and variable gain devices are catered for by the iterative process or by measurements carried out individually on the active modules. The effect on the individual radiation diagrams of the sources due to coupling between them are allowed for by the non-diagonal terms of the matrix $R=[r_{ij}]$.

The calibration method in accordance with the invention is thus better than the calibration methods of the prior art because it allows for errors which are not allowed for in the prior art methods. Also, the measurements of the method in accordance with the invention are faster because only one scan of the near field probe is required (if there is no need for successive iterations, for example if the active modules are measured individually), with only N measurement positions where N is the number of active modules. In the prior art a map of the entire near field is required with a maximum spacing of $(\lambda/2)^2$ over a surface area two to three times greater than that of the antenna. The switching of N bits by 180° for each position of the probe is effected very quickly for an electronically controlled antenna.

Because the method in accordance with the invention allows for manufacturing tolerances, the range of permissible values for these parameters (variable gain, phase shift) can be increased. Tight specifications leading to the rejection of a large number of components are no longer necessary. The method in accordance with the invention does not require any dedicated circuits in the active antenna. The prior art methods, on the other hand, require the integration of a "calibration BFN", a dedicated receiver for each module or a switch for loading each module individually and only for the purposes of calibration, for example.

There is claimed:

1. A method of calibrating an active antenna having N radiating sources respectively associated with N signal channels each having an active module including a phase shifter, said method comprising the steps of: placing only a single probe in front of each radiating source in succession to measure the near field in front of said source for an antenna configuration required to obtain a required radiation pattern; and, during said measuring of said near field in front of said source, causing the phase shifter of each channel in turn to shift the phase of radiation by said channel 180° relative to its nominal value while maintaining each of the other N–1 sources operating at their respective nominal value for said configuration in order to obtain the required radiation pattern, whereby phase control values are determined and applied to each phase shifter to effect the calibrating of the antenna.

2. The method according to claim 1 for calibrating an active antenna, wherein the active modules are arranged in a mesh whose size is significantly greater than λ/2 in at least one dimension of the antenna, further comprising: carrying out K near field measurements in front of each radiating source and, then, for each source, averaging said K measurements to determine the near field pattern of each radiating source.

3. Method according to claim 1 applied to transmit active antennas.

4. Method according to claim 1 applied to receive active antennas.

5. The method according to claim 4 applied to a radar antenna twice: once for the antenna transmitting to determine transmit phase shift and gain control values, and again for the antenna receiving to determine receive phase shift and gain control values.

6. Method according to claim 1 applied to receive active antennas alternately transmitting and receiving.

7. The method of calibrating an active antenna according to claim 1, wherein said N radiating sources are disposed in an array with coupling between said sources, and wherein each active module further includes variable gain control means, said sources, said active modules, said phase shifters and said gain control means having predetermined manufacturing tolerances, and said phase shifter and said gain control means being subject to inaccuracies of response conditioned by a given control value, whereby said measuring of said near field simultaneously characterizes the effects of said coupling between sources, said manufacturing tolerances and said inaccurate responses, said method further comprising the step of: determining gain control values and applying them to said gain control means to effect calibration.

8. The method according to claim 7, further comprising: first determining the gain and phase control values for a required antenna configuration to obtain a required radiation pattern by said method according to claim; and, then, repeating both the application of said control values to said phase shifter and gain control means, and also said near field measuring step, to obtain closer corrections to said values by successive iterations.

9. The method according to claim 7, further comprising: carrying out the measuring on said active modules before the antenna is assembled and after the gain and phase control values are determined;

then, storing the determined gain and phase control values in a calibration table; and, then, further refining said gain and phase control values by an iterative subroutine using said calibration table.

10. Method according to claim 7 applied to transmit active antennas.

11. Method according to claim 7 applied to receive active antennas.

12. The method according to claim 11 applied to a radar antenna twice: once for the antenna transmitting to determine transmit phase shift and gain control values, and again for the antenna receiving to determine receive phase shift and gain control values.

13. Method according to claim 7 applied to receive active antennas alternately transmitting and receiving.

14. A method of calibrating an active antenna having N radiating sources respectively associated with N signal channels each having an active module including phase shift means and gain control means, said method comprising the steps of: placing only a single probe in front of each radiating source in succession and measuring the near field in front of said source for an antenna configuration required to obtain a required radiation pattern; during said measuring of said near field in front of said source, causing the phase shift means of each channel in turn to shift the phase of radiation by said channel 180° relative to its nominal value while maintaining each of the other N−1 sources operating at their respective nominal value for said configuration in order to obtain the required radiation pattern; and determining gain and phase control values and applying them to each phase shift means and gain control means to effect the calibrating of the antenna.

15. The method according to claim 14, further comprising: first, determining the gain and phase control values for a required antenna configuration to obtain a required radiation pattern by said method according to claim 14; and, then repeating both the application of said control values to said phase shift and gain control means, and also said near field measuring step, to obtain closer corrections to said values by successive iterations.

16. The method according to claim 14, further comprising: carrying out the measuring on said active modules before the antenna is assembled and after the control values are determined by the method according to claim 14;

then, storing the determined control values in a calibration table; and, then, further refining said control values by an iterative subroutine using said calibration table.

17. The method according to claim 14, further comprising: carrying out the measuring on said active modules before the antenna is assembled and after the control values are determined by the method according to claim 16; then, storing the determined control values in a calibration table; and, then, further refining said control values by an iterative subroutine using said calibration table.

* * * * *